US006102515A

United States Patent [19]

Edwards et al.

[11] Patent Number: 6,102,515

[45] Date of Patent: Aug. 15, 2000

[54] PRINTHEAD DRIVER FOR JETTING HEATERS AND SUBSTRATE HEATER IN AN INK JET PRINTER AND METHOD OF CONTROLLING SUCH HEATERS

[75] Inventors: Mark Joseph Edwards; Bruce David Gibson, both of Lexington; George Keith Parish, Winchester, all of Ky.

[73] Assignee: Lexmark International, Inc., Lexington, Ky.

[21] Appl. No.: 08/827,404

[22] Filed: Mar. 27, 1997

[51] Int. Cl.[7] ..... B41J 29/38

[52] U.S. Cl. ..... 347/17; 347/57

[58] Field of Search ..... 347/17, 57, 10

[56] References Cited

U.S. PATENT DOCUMENTS

| | | | |
|---|---|---|---|
| 4,539,571 | 9/1985 | Suzuki | 346/76 PH |
| 4,623,903 | 11/1986 | Hashimoto | 346/76 PH |
| 5,057,855 | 10/1991 | Damouth | 347/57 |
| 5,107,276 | 4/1992 | Kneezel et al. | 346/1.1 |
| 5,175,565 | 12/1992 | Ishinaga et al. | 347/17 |

*Primary Examiner*—John Barlow
*Assistant Examiner*—Michael Brooke
*Attorney, Agent, or Firm*—John J. McArdle

[57] ABSTRACT

The invention is directed to an ink jet printer including a printhead and a printhead driver. The printhead includes a substrate, a nozzle plate having a plurality of ink emitting orifices, a plurality of jetting heaters on the substrate and respectively associated with the plurality of ink emitting orifices, and at least one substrate heater associated with the substrate. Each of the jetting heaters and the substrate heaters include first and second terminals. The printhead driver has a plurality of energizable outputs including at least one power line output and at least two enable line outputs. One power line output is electrically connected to a first terminal of each of a jetting heater and a substrate heater. Two of the enable line outputs are coupled to a second terminal of the jetting heater and a second terminal of the substrate heater. During energizing of the one power line output, the jetting heater and the substrate heater may be selectively actuated by selectively energizing the two enable line outputs.

11 Claims, 3 Drawing Sheets

PRINTHEAD DRIVER FOR JETTING HEATERS AND SUBSTRATE HEATER IN AN INK JET PRINTER AND METHOD OF CONTROLLING SUCH HEATERS

BACKGROUND OF THE INVENTION

1. Field of the Invention

The present invention relates to ink jet printers, and, more particularly, to ink jet printers including a plurality of jetting heaters and at least one substrate heater.

2. Description of the Related Art

An ink jet printer typically includes a printhead having a nozzle plate which is connected to and mounted in spaced apart relationship relative to a substrate. The nozzle plate includes a plurality of ink emitting orifices which are respectively disposed in association with a plurality of jetting heaters mounted on the substrate. When a particular jetting heater is actuated or fired, ink disposed adjacent thereto rapidly expands to form a vapor bubble. Ink is expelled through the ink emitting orifice by the bubble and is jetted onto the print medium.

During use, selective actuation of the plurality of jetting heaters within the printhead causes the operating temperature of the printhead to increase. The increased operating temperature of the printhead in turn causes the temperature of the ink disposed within the printhead to correspondingly increase. A change in the temperature of the ink results in a change of the physical properties of the ink, such as viscosity, surface tension, etc. It has been found that the drop mass and velocity of the ink droplets which are jetted onto the print medium vary with a change in the operating temperature of the ink within the printhead, thus affecting the print quality.

It is known to provide at least one substrate heater which is mounted on the substrate within the printhead for the purpose of maintaining the ink within the printhead at an approximate desired operating temperature, thereby providing a more uniform and improved print quality. The substrate heaters are typically actuated upon initial power-up of the printhead or during periods of inactivity of the printhead such that the ink within the printhead is maintained at an approximate desired temperature.

Conventional printheads employing one or more substrate heaters typically include driver circuitry for driving the substrate heaters which is separate from the driver circuitry for driving the jetting heaters. Using separate driver circuitry, the substrate heaters may be independently and selectively energized separate from the jetting heaters. However, the separate driver and interconnect circuitry associated with the substrate heaters increases the cost and complexity associated with the printer and printhead.

What is needed in the art is an ink jet printer having a printhead with both jetting heaters and substrate heaters, without the increased cost and complexity associated with using separate printer driver circuits as heretofore known.

SUMMARY OF THE INVENTION

The present invention provides a printhead driver for a printhead in an ink jet printer which is capable of controlling the operation of both a plurality of jetting heaters and at least one substrate heater.

The invention comprises, in one form thereof, an ink jet printer including a printhead and a printhead driver. The printhead includes a substrate, a nozzle plate having a plurality of ink emitting orifices, a plurality of jetting heaters on the substrate and respectively associated with the plurality of ink emitting orifices, and at least one substrate heater associated with the substrate. Each of the jetting heaters and the substrate heaters include first and second terminals. The printhead driver has a plurality of energizable outputs including at least one power line output and at least two enable line outputs. One power line output is electrically connected to a first terminal of each of a jetting heater and a substrate heater. Two of the enable line outputs are coupled to a second terminal of the jetting heater and a second terminal of the substrate heater. During energizing of the one power line output, the jetting heater and the substrate heater may be selectively actuated by selectively energizing the two enable line outputs.

An advantage of the present invention is that a printhead driver may be used to selectively actuate a plurality of jetting heaters and/or a substrate heater, without the use of a separate driver for the substrate heater.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
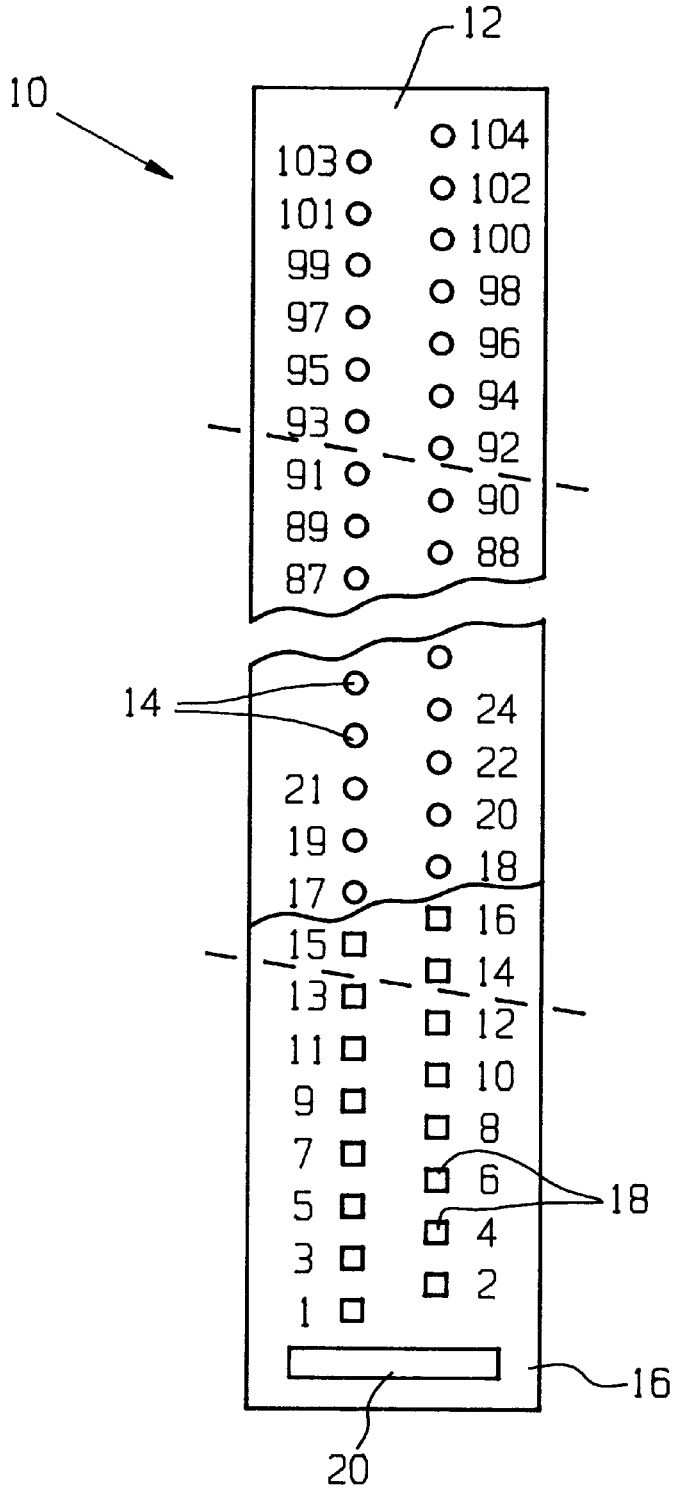
FIG. 1 is a schematic view of a conventional printhead with which the printhead driver of the present invention may be used, illustrating a typical configuration of ink emitting orifices, jetting heaters and substrate heater.

Referring now to the drawings and more particularly to FIG. 1, there is shown a schematic view of a printhead 10 of the present invention with which the printhead driver, described in more detail hereinafter, may be used. Printhead 10 includes a nozzle plate 12 having a plurality of ink emitting orifices 14 formed therein. In the embodiment shown, ink emitting orifices 14 are formed in two vertical columns with fifty two ink emitting orifices 14 in each column, (i.e., a 2×52 array). Ink emitting orifices 14 are shown staggered or off-set relative to ink emitting orifices 14 in an adjacent row by a distance of approximately one-half the distance between vertically adjacent orifices 14. However, ink emitting orifices 14 may be substantially aligned relative to each other between adjacent columns.

Printhead 10 also includes a substrate 16 which is connected to nozzle plate 12. A plurality of jetting heaters 18 are mounted on substrate 16 and positioned relative to respective ink emitting orifices 14. More particularly, each of the plurality of jetting heaters 18 is positioned substantially in axial alignment with a respective ink emitting orifice 14. Actuation of a jetting heater 18 rapidly heats the ink disposed adjacent thereto, and creates a gas bubble which jets ink from the associated ink emitting orifice 14.

A pair of substrate heaters 20, one of which is shown in FIG. 1, are also mounted on substrate 16 at opposite ends of printhead 10 outside the area where jetting heaters 18 are located. Substrate heaters 20 may be actuated to provide additional heat to printhead 10 and thereby control the operating temperature of printhead 10. As the operating temperature of printhead 10 varies, the temperature of the ink within printhead 10 likewise varies which results in varying physical properties of the ink such as viscosity, etc. Maintaining the operating temperature of printhead 10 at an approximate desired level provides an improved print quality by maintaining physical properties of the ink at a relatively constant level. Although printhead 10 shown in FIG. I includes two substrate heaters 20, more or fewer substrate heaters may be utilized depending upon the particular application and the heat transfer characteristics of printhead 10.

Figure 2:
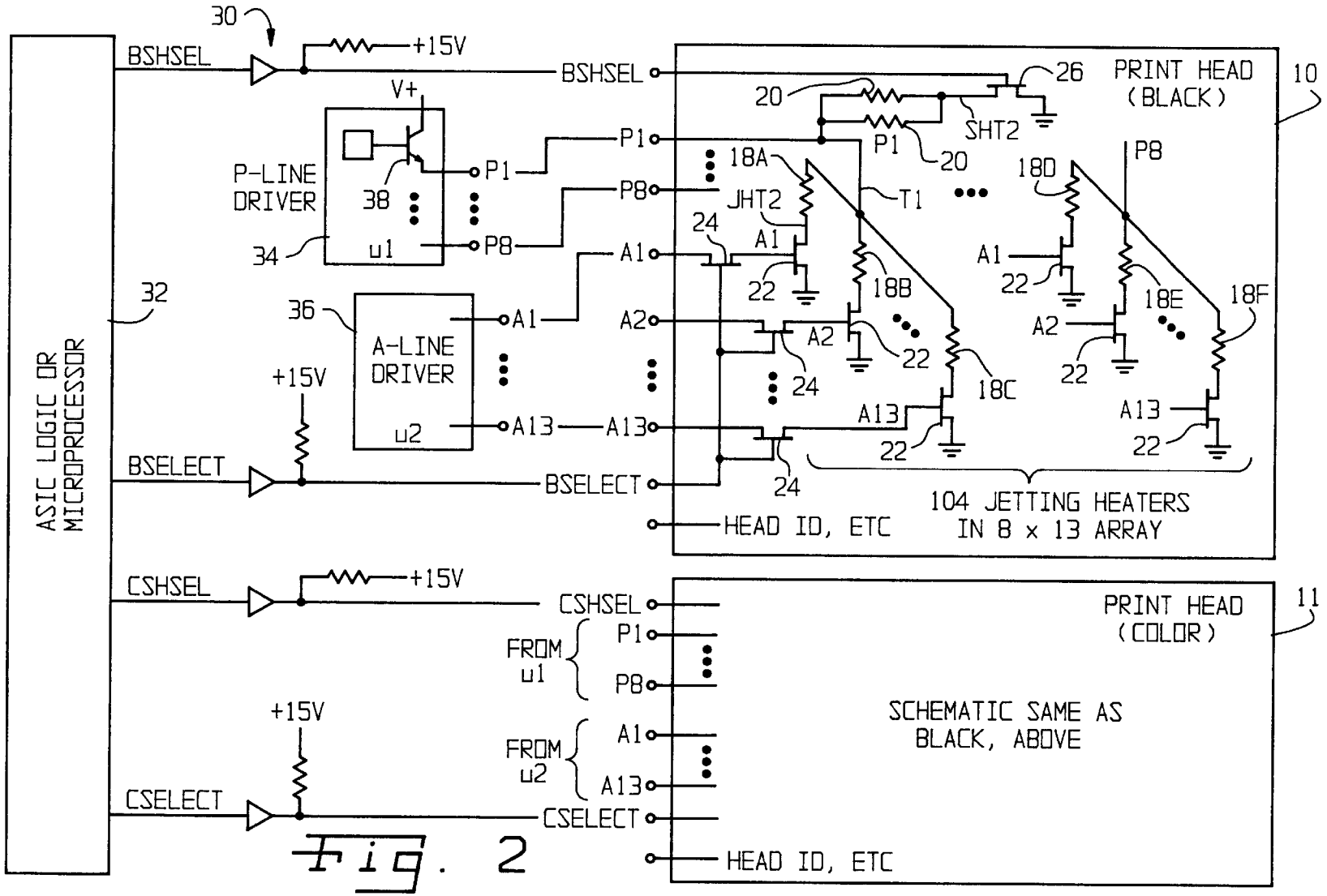
FIG. 2 is a schematic illustration of one embodiment of a printhead driver of the present invention.

Referring now to FIG. 2, there is shown a schematic illustration of one embodiment of a printhead driver 30 of the present invention which may be used with printhead 10. Printhead driver 30 of the present invention includes an Application Specific Integrated Circuit (ASIC) or microprocessor 32, P-line driver 34 and A-line driver 36.

Printhead 10 includes a plurality of pins A1 through A13 which are respectively connected with a group of thirteen ink jetting heaters 18, shown as resistor elements and individually referenced 18A–18F in FIG. 2. Each group of thirteen jetting heaters 18 shown in FIG. 2 corresponds to each consecutive group of thirteen jetting heaters 18 shown in FIG. 1. That is, jetting heaters 18 labeled 1–13 in FIG. 1 correspond to the first group of jetting heaters 18, jetting heaters 18 labeled 92–104 in FIG. 1 correspond to the last group of jetting heaters, etc. There are eight separate groups of thirteen jetting heaters 18, with each of the thirteen jetting heaters 18 being respectively connected with pins A1 through A13. A plurality of MOS transistors 22 are respectively associated with each jetting heater 18 and provide selective actuation of the respective jetting heaters 18, as will be described in more detail hereinafter. Of course, those skilled in the art will recognize that the grouping of ink jet heaters may be varied, such as for example, by forming a grouping of nozzles arranged in a single column.

A plurality of additional transistors 24 are electrically connected with respective pins A1 through A13 and provide selective actuation of the entire printhead 10 shown in FIG. 2. Transistors 24 are connected with a pin labeled BSELECT allowing selection of black printhead 10.

Each of the eight groups of thirteen jetting heaters 18 include first terminals T1 which are respectively connected with high side, power pins P1 through P8. Any of the jetting heaters 18 of printhead 10 may be selectively actuated by applying power to one of the power pins P1 through P8 and selectively energizing MOS transistors 22 associated with one of the pins A1 through A13. For example, to selectively energize jetting heater 18A, power is applied to pin P1 which in turn applies power to a first terminal of jetting heater 18A. Assuming that printhead 10 has been selected for operation by closing transistors 24, a signal may be applied to pin A1 for actuating MOS transistor 22 associated with jetting heater 18A. Actuation of MOS transistor 22 associated with jetting heater 18A closes the circuit to ground and allows jetting heater 18A to be selectively energized. Although the other seven MOS transistors 22 associated with the other seven groups of thirteen jetting heaters are also actuated by applying the signal to pin A1, no power is applied to pins P2 through P8. Thus, jetting heater 18D associated with pin P8 is not selectively energized when power is applied to pin P1. To selectively energize jetting heater 18D, power is applied to pin P8 and a signal is applied to pin A1. Thus, any of the jetting heaters 18 in the 104 jetting heaters of the 2×52 array of jetting heaters may be selectively energized using pins P1 through P8 and pins A1 through A13.

Printhead 10 also includes a pin labeled BSHSEL for selective actuation of substrate heaters 20 associated with black printhead 10. Substrate heaters 20 are also shown as resistor elements in the electrical schematic shown in FIG. 2. Pin BSHSEL is connected to a transistor 26 for selectively energizing substrate heaters 20. More particularly, when power is applied to pin P1, a signal may be applied to pin BSHSEL to actuate transistor 26 and close the circuit to ground with respect to substrate heaters 20. Thus, substrate heaters 20 may be selectively energized any time that power is applied to pin P1 by selectively opening or closing transistor 26. In the embodiment shown, substrate heaters 20 are connected at a first terminal T1 thereof with power pin P1 and connected at a second terminal SHT2 thereof with transistor 26. However, it is also to be understood that substrate heaters 20 may be connected to any of the power pins P1 through P8. Moreover, rather than using one transistor 26, a pair of transistors 26 may be respectively associated with each substrate heater 20 for allowing individual and selective operation of substrate heaters 20. Additionally, substrate heaters 20 may be individually and respectively connected to two of the power pins P1 through P8.

An additional pin shown at the bottom of printhead 10 in FIG. 2 is used for identification of the particular printhead, etc.

Microprocessor 32 includes an enable line output which is connected with and provides a select signal BSHSEL to pin BSHSEL of printhead 10. Select signal BSHSEL opens and closes transistor 26, as described above. Microprocessor 32 also provides a select signal BSELECT to pin BSELECT of printhead 10. Select signal BSELECT is used to open and close transistors 24 for selective operation of printhead 10.

P-line driver 34 includes a plurality of energizable power line outputs P1 through P8 which are respectively connected to pins P1 through P8 of printhead 10. Power line output P1 is connected with the first group of thirteen jetting heaters 18, and also is connected with substrate heaters 20, as described above. Power line outputs P2 through P8 are respectively connected with the seven other groups of thirteen jetting heaters 18 in printhead 10. More particularly, a transistor 38 in P-line driver 34 selectively couples power line output P1 to a voltage source reference V+. Any one of the eight groups of thirteen jetting heaters 18 may be selectively connected with voltage source V+ using one of eight associated transistors like transistor 38 in P-line driver 34.

A-line driver 36 includes a plurality of enable line outputs A1 through A13 which are respectively connected with pins A1 through A13 of printhead 10. Enable line outputs A1 through A13 are coupled with second terminals JHT2 of respective jetting heaters 18 in printhead 10. Enable line outputs A1 through A13 may be selectively energized to actuate MOS transistors 22 connected therewith.

During use, any of the jetting heaters 18 in the eight groups of jetting heaters 18 may be selectively energized by coupling one of the power line outputs P1 through P8 to a first terminal of each of the jetting heaters in a selected group of jetting heaters. Enable line outputs A1 through A13 of A-line driver 36 are then selectively energized to actuate an associated MOS transistor 22 and close the circuit to ground of the corresponding jetting heater 18. Substrate heaters 20 may be selectively actuated by selectively energizing enable line output BSHSEL from microprocessor 32 to close transistor 26 when power is applied to pin P1.

Printhead 10 may be incorporated into an ink jet cartridge which is carried by a carriage assembly which traverses the width of a print medium during printing, in known manner. A print image is defined with respect to the print medium, with a print margin positioned at each side of the print image. In one embodiment of the invention, transistors 24 are actuated as printhead 10 traverses across the print image such that selective actuation of MOS transistors 22 causes ink to be jetted onto the print medium using the associated jetting heaters 18. When printhead 10 is positioned in the margins outside the area of the print image, transistors 24 are deactuated and power is applied to substrate heaters 20 by applying power to pin P1 and actuating transistor 26. Substrate heaters 20 are therefore selectively energized when printhead 10 is in the margins, resulting in decreased cooling of printhead 10 associated with inactivity of jetting heaters 18.

In addition to having a single printhead 10, the ink jet printer may also include one or more additional printheads for jetting different colored inks onto the jet medium. For example, a second printhead 11 is shown in FIG. 2 for jetting a colored ink such as cyan, magenta or yellow ink onto the print medium. The electrical schematic for printhead 11 is the same as that shown and described with reference to black printhead 10, and thus will not be described in detail.

Figure 3:
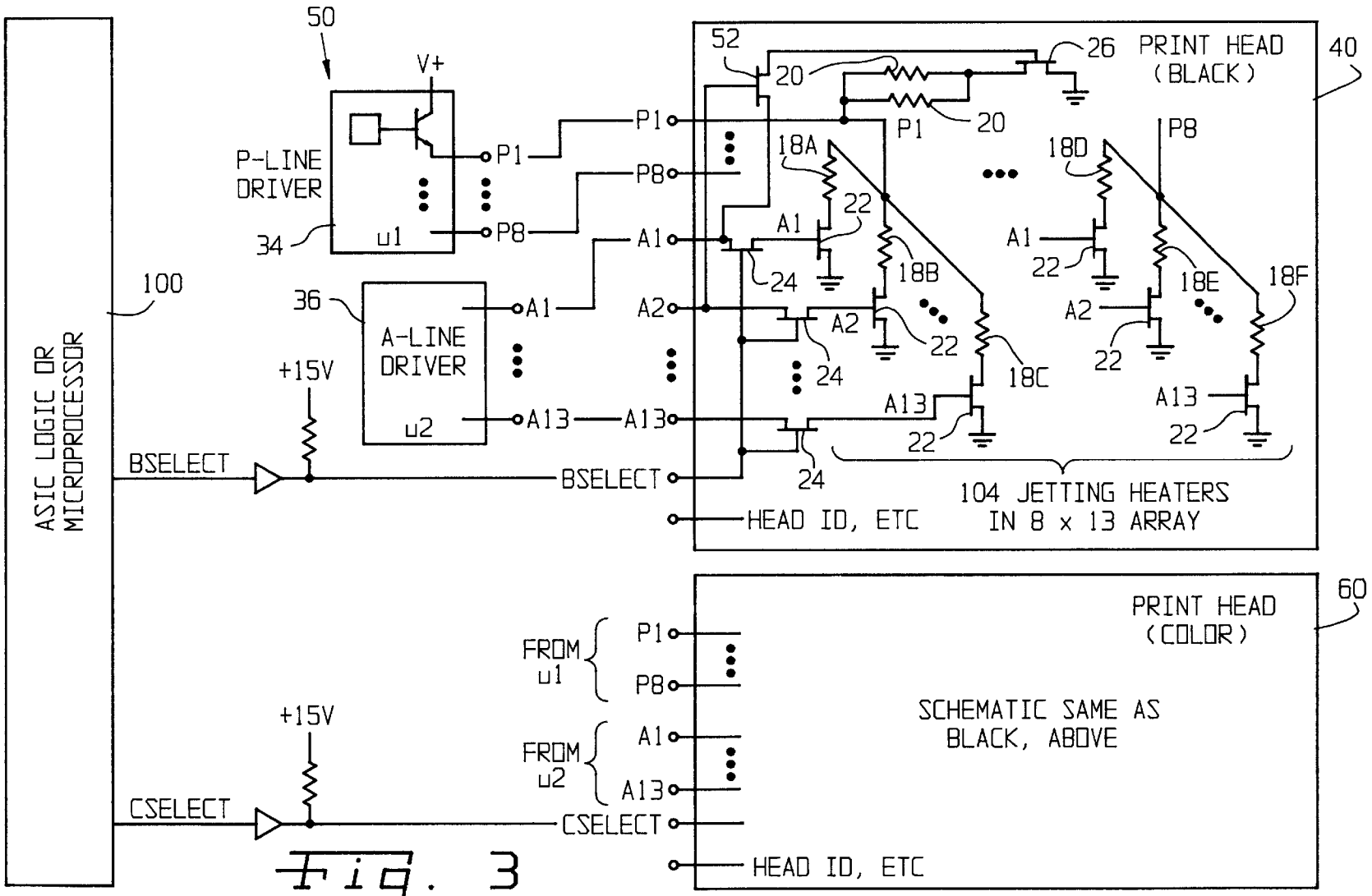
FIG. 3 is a schematic illustration of another embodiment of a printhead driver of the present invention.

Referring now to FIG. 3, there is shown a schematic illustration of another embodiment of a printhead driver 50 of the present invention. Printhead driver 50 includes a P-line driver 34 and an A-line driver 36 which are configured the same as described above with reference to the embodiment shown in FIG. 2. Printhead driver 50 also includes an ASIC or microprocessor 100 which is similar to microprocessor 32 shown in FIG. 2. However, microprocessor 100 does not include an enable line output BSHSEL for selectively energizing substrate heaters 20. Rather, substrate heaters 20 are selectively energized using circuitry within printhead 40.

Printhead 40 is configured much the same as printhead 10 shown in FIG. 2. However, printhead 40 does not include a pin BSHSEL shown in FIG. 2. Rather, two of the pins A1 through A13 of printhead 40 are coupled with substrate heaters 20. To wit, pin A1 is connected with transistor 26 and pin A2 is coupled to a transistor 52. Actuating transistor 52 closes the connection between pin A1 and transistor 26, allowing transistor 26 to be actuated for energizing substrate heaters 20.

During use, transistors 24 are closed when printhead 40 is positioned in the area of the print image to allow selective operation of MOS transistors 22. When printhead 40 is positioned in the margins outside the area of the print image, transistors 24 are deactuated. With transistors 24 open, enable line outputs A1 and A2 from A-line driver 36 are each actuated. Actuation of enable line output A2 closes transistor 52, and actuation of enable line output A1 closes transistor 26. With power applied from power line output P1, and with transistors 52 and 26 both closed, substrate heaters 20 are selectively energized to heat printhead 40.

Color printhead 60 shown in FIG. 3 includes an electrical schematic which is the same as black printhead 40, and will not be described in further detail. However, it is to be understood that the same or a different P-line driver and/or A-line driver may be connected with each separate printhead. Moreover, the actual combination of power line outputs and enable line outputs may vary from one printhead to another.

In the embodiment of the present invention shown in FIGS. 2 and 3 and described above, printheads 10, 11 and 40, 60, respectively, include thirteen pins A1 through A13 which are each coupled to a plurality of corresponding jetting heaters 18. For example, pin A1 is connected to each of jetting heaters 18A and 18D shown in FIGS. 2 and 3. However, printheads 10, 11 and 40, 60 may include separate pins A1 . . . AN associated with each jetting heater 18 in the eight groups of jetting heaters. That is, each of printheads 10, 11 and 40, 60 may include 104 pins A1–A104 which are respectively coupled to jetting heaters 18 in the 2×52 array of jetting heaters 18. Of course, if printheads 10, 11 and 40, 60 are configured in this manner, A-line driver 36 would include 104 enable line outputs A1–A104.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printer comprising:

a printhead including a substrate, a nozzle plate having a plurality of ink emitting orifices, said nozzle plate being, mounted on said substrate, a plurality of jetting heaters on said substrate, said plurality of jetting heaters being fluidly connected with said ink emitting orifice and heating ink emitted from said plurality of ink emitting orifices, and at least one substrate heater heating said substrate, each of said jetting heaters and said substrate heaters including first and second terminals, a first said jetting heater and said at least one substrate heater having a common said first terminal, a voltage source, and a printhead driver having a plurality of energizable outputs, said printhead driver connecting said plurality of outputs with said voltage source, said plurality of outputs including at least one power line output and at least two enable line outputs, said at least one power line output being electrically connected to said common first terminal of said first jetting heater and said at least one substrate heater, a first of said at least two enable line outputs being coupled to at least one of said second terminal of said first jetting heater and said second terminal of said at least one substrate heater, and a second of said at least two enable line outputs being coupled to at least one of said second terminal of said first jetting heater and said second terminal of said at least one substrate heater, wherein during energizing of said at least one power line output, at least one of said first jetting heater and said at least one substrate heater absorbs electrical power while at least one of said at least two enable line outputs is energized.

2. The ink jet printer of claim 1, wherein a first of said at least two enable line outputs is coupled to said second terminal of said first jetting heater and a second of said at least two enable line outputs is coupled to said second terminal of said at least one substrate heater, said first jetting heater absorbing electrical power while said first enable line output is energized, said at least one substrate heater absorbing electrical power while said second enable line output is energized.

3. The ink jet printer of claim 1, wherein a first of said at least two enable line outputs is coupled to said second terminal of said first jetting heater and said second terminal of said at least one substrate heater, and wherein a second of said at least two enable line outputs is coupled to said second terminal of a second jetting heater and said second terminal of said at least one substrate heater, wherein electrical power can be applied to at least one of said first jetting heater, said second jetting heater and said at least one substrate heater by selectively energizing said first and second enable line outputs.

4. The ink jet printer of claim 3, wherein said first enable line output is individually energized for applying electrical power to said first jetting heater, and said second enable line output is individually energized for applying electrical power to said second jetting heater, and wherein said first and second enable line outputs are simultaneously energized for applying electrical power to said at least one substrate heater.

5. The ink jet printer of claim 1, wherein said at least two enable line outputs include a select line output, said printhead driver further comprising an electrical processor having said select line output, said select line output being connected to and providing at least one select signal to said printhead, said absorption of electrical power of said first jetting heater being dependent upon said select signal.

6. The ink jet printer of claim 5, wherein said select signal couples and decouples one of said at least two enable line outputs with said first jetting heater.

7. A method of controlling an operating temperature of a printhead in an ink jet printer, comprising the steps of:

providing a printhead including a substrate, a nozzle plate having a plurality of ink emitting orifices, said nozzle plate being mounted on said substrate, a plurality of jetting heaters on said substrate, said plurality of jetting heaters being fluidly connected with said ink emitting orifice and heating ink emitted from said plurality of ink emitting orifices, and at least one substrate heater configured for heating said substrate, each of said jetting heaters and said substrate heaters including first and second terminals, a first said jetting heater and said at least one substrate heater having a common said first terminal:

providing a voltage source;

providing a printhead driver having a plurality of energizable outputs, said printhead driver for connecting said plurality of outputs with said voltage source, said plurality of outputs including at least one power line output and at least two enable line outputs, electrically connecting said at least one power line output to said common first terminal of said first jetting heater and said at least one substrate heater;

coupling a first of said at least two enable line outputs to at least one of said second terminal of said first jetting heater and said second terminal of said at least one substrate heater, and coupling a second of said at least two enable line outputs to at least one of said second terminal of said first jetting heater and said second terminal of said at least one substrate heater;

energizing said selected at least one power line output; and applying electrical power to at least one of said first jetting heater and said at least one substrate heater, during said energizing of said at least one power line output, by energizing at least one of said at least two enable line outputs.

8. The method of claim 7, comprising the further steps of:

coupling a first of said at least two enable line outputs to said second terminal of said first jetting heater;

coupling a second of said at least two enable line outputs to said second terminal of said at least one substrate heater;

applying electrical power to said first jetting heater by energizing said first enable line output; and applying electrical power to said at least one substrate heater by energizing said second enable line output.

9. The method of claim 7, comprising the further steps of:

coupling a first of said at least two enable line outputs to said second terminal of said first jetting heater and said second terminal of said at least one substrate heater;

coupling a second of said at least two enable line outputs to said second terminal of a second jetting heater and said second terminal of said at least one substrate heater; and applying electrical power to at least one of said first jetting heater, said second jetting heater and said at least one substrate heater by selectively energizing said first and second enable line outputs.

10. The method of claim 9, comprising the further steps of:

individually energizing said first enable line output for applying electrical power to said first jetting heater;

individually energizing said second enable line output for applying electrical power to said second jetting heater; and simultaneously energizing said first and second enable line outputs for applying electrical power to said at least one substrate heater.

11. The method of claim 7, wherein said coupling step comprises:

coupling a first of said at least two enable line outputs to said second terminal of said first jetting heater; and coupling a second of said at least two enable line outputs to said second terminal of said at least one substrate heater.

* * * * *